US009290241B2

(12) United States Patent
Kweldam et al.

(10) Patent No.: US 9,290,241 B2
(45) Date of Patent: Mar. 22, 2016

(54) VESSEL COMPRISING A CRANE

(75) Inventors: Dennis Kweldam, Dordrecht (NL); Erwin Cornelis Johannes Bijvoet, Zevenbergen (NL)

(73) Assignee: IHC HOLLAND IE B.V., Sliedrecht (NL)

( * ) Notice: Subject to any disclaimer, the term of this patent is extended or adjusted under 35 U.S.C. 154(b) by 102 days.

(21) Appl. No.: 14/111,216

(22) PCT Filed: Apr. 13, 2012

(86) PCT No.: PCT/NL2012/050242

§ 371 (c)(1),
(2), (4) Date: Dec. 3, 2013

(87) PCT Pub. No.: WO2012/141584

PCT Pub. Date: Oct. 18, 2012

(65) Prior Publication Data

US 2014/0093334 A1 Apr. 3, 2014

(30) Foreign Application Priority Data

Apr. 14, 2011 (NL) ..... 2006605

(51) Int. Cl.

| | |
|---|---|
| ***B66C 23/53*** | (2006.01) |
| ***B63B 27/10*** | (2006.01) |
| ***B66C 23/82*** | (2006.01) |
| ***B66C 23/52*** | (2006.01) |
| ***E02F 3/46*** | (2006.01) |
| ***E02F 3/88*** | (2006.01) |
| ***E02F 3/90*** | (2006.01) |

(52) U.S. Cl.

CPC ..... *B63B 27/10* (2013.01); *B66C 23/52* (2013.01); *B66C 23/82* (2013.01); *E02F 3/46* (2013.01); *E02F 3/8841* (2013.01); *E02F 3/905* (2013.01)

(58) Field of Classification Search

CPC ..... B66C 23/52; B66C 23/605; B66C 23/82; B66C 23/06; B66C 23/14; B66C 23/54; B66C 23/60; B63B 23/20; B63B 27/04; B63B 27/10; B63B 23/10; B63B 27/08; B63B 27/12; B63B 27/16

USPC ..... 212/307, 308, 255, 260, 261

See application file for complete search history.

(56) References Cited

U.S. PATENT DOCUMENTS

| | | | | |
|---|---|---|---|---|
| 6,082,947 | A | 7/2000 | Adamson | |
| 6,491,174 | B1 * | 12/2002 | Day | 212/179 |
| 2008/0121603 | A1 * | 5/2008 | Leinonen | 212/300 |

FOREIGN PATENT DOCUMENTS

| | | |
|---|---|---|
| CN | 201647854 | 11/2010 |
| DE | 198 02 458 | 8/1999 |
| DE | 201 17 060 | 2/2002 |
| NL | 1004451 C1 | 5/1998 |

OTHER PUBLICATIONS

International Search Report dated Jul. 20, 2012, corresponding to PCT/NL2012/050242.

* cited by examiner

*Primary Examiner* — Sang Kim
*Assistant Examiner* — Juan Campos, Jr.
(74) *Attorney, Agent, or Firm* — Young & Thompson

(57) ABSTRACT

A vessel (4) includes a crane (1) connected to a deck (5) of the vessel. The crane (1) includes a frame (10) which is rotatable about a horizontal hinge axis (H), a rotation mechanism (20) connected to the frame (10) at a position away from the horizontal hinge axis (H), arranged to rotate the frame (10) about the horizontal hinge axis (H) from an upper position to a lower position and vice versa, and a swivel member (30), which is with a first end (31) rotatable connected to the deck (5) and which is with a second end (32) rotatable connected to the rotation mechanism (20). The swivel member (30) is rotatable between an inward position associated with the upper position of the frame (10) to an outward position associated with the lower position of the frame (10).

20 Claims, 2 Drawing Sheets

VESSEL COMPRISING A CRANE

TECHNICAL FIELD

Figure 1:
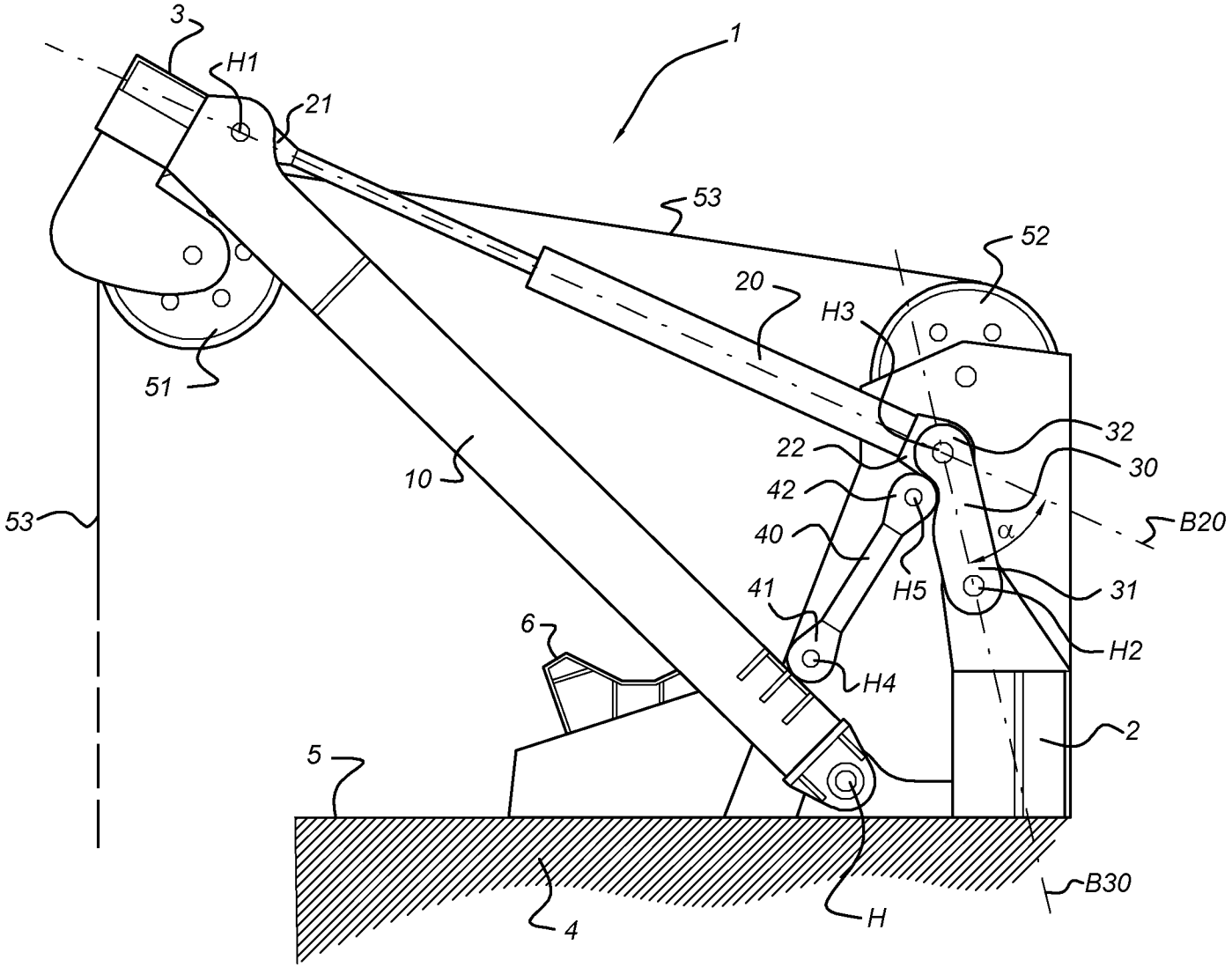

The invention relates to a vessel comprising a crane, the crane being connected to a deck of the vessel, the crane comprising a frame which is rotatable about a horizontal hinge axis, and a rotation mechanism connected to the frame at a position away from the horizontal hinge axis, which is arranged to rotate the frame about the horizontal hinge axis from an upper position to a lower position and vice versa, wherein in the upper position a top of the crane is higher than in the lower position.

STATE OF THE ART

Cranes on vessels are used to load or unload loads from or to the vessel. The cranes may also be used to hoist equipment from the vessel into the sea or from the sea onto the vessel. The equipment may for instance be dredging equipment, such as a suction pipe or excavation tool.

NL1004451C1 describes such a crane comprising a frame which is positioned on a deck of a vessel and is connected to the vessel by means of a hinge axis. The crane further comprises means for rotating the frame, wherein the means extend between the frame and a support connected to the vessel. The means may be hydraulic cylinders.

Vessels are becoming larger. The distance from the deck to the water surface also becomes larger. It has been found that the frequency of often occurring waves (approx. 0.1 Hz) now becomes close to the natural frequency of the hoisting cable with the load (e.g. a suction tube) attached to it, which may cause the hoisting cable with the load to resonate and swing excessively when such a load is hoisted from or to the water surface.

A typical length of the free end of the hoisting cable may be 23 meters. This corresponds to a natural time of oscillation close to 10 seconds (using $T=2\pi\sqrt{(1/g)}$), or 0.1 Hz, which is close to a typical wave frequency at sea.

As a result, the load may collide against the hull of the vessel during loading or unloading. This may cause damage to the vessel and the load and makes load handling complicated.

SHORT DESCRIPTION

It is an object of the invention to provide a crane which overcomes the above problem.

According to an aspect there is provided a vessel comprising a crane, the crane being connected to a deck of the vessel, the crane comprising a frame which is rotatable about a horizontal hinge axis, and a rotation mechanism connected to the frame at a position away from the horizontal hinge axis, which is arranged to rotate the frame about the horizontal hinge axis from an upper position to a lower position and vice versa, wherein in the upper position a top of the crane is higher than in the lower position, wherein the crane further comprises a swivel member, which is with a first end rotatable connected to deck and which is with a second end rotatable connected to the rotation mechanism, wherein the swivel member is rotatable from an inward position associated with the upper position of the frame to an outward position associated with the lower position of the frame and vice versa.

The upper position of the crane may correspond to an onboard position wherein the top of the crane is above the deck of the vessel. The lower position of the crane may correspond to an overboard position wherein the top of the crane is above the water surface.

When moving from the inward position to the outward position, the second end of the swivel member moves towards the frame-side of the crane, i.e. moves towards the edge of the deck. In the inward position, the second end of the swivel member is further removed from the edge of the vessel than in the outward position. The inward position corresponds to a more up-right position of the swivel member where the outward position corresponds to a more horizontal position of the swivel member.

As a result, the rotation mechanism is not fixedly attached to the vessel or the base member, but is connected to the vessel via the swivel member. The swivel member allows the rotation mechanism to move in a direction away from the vessel when moving from the upper position to the lower position and vice versa. This provides the end of the rotation mechanism attached to the frame with an increased freedom of movement, thereby allowing the crane to reach a relatively low position.

Such a crane is capable of positioning the top of the crane in a relatively low position with respect to a base of the crane. As a result, the distance from the top of the crane to the water surface is reduced and the length of the free end of the hoisting cable is thus also reduced. By reducing the free end of the hoisting cable, the natural frequency of the hoisting cable is no longer close to the frequency of the waves thereby reducing the chance of excessive swing.

Such a crane further provides the advantage that the top of the crane can be positioned in a relatively low position with respect to the base of the crane, while the footprint of the crane (i.e. the area on the deck occupied by the base), is relatively small.

By connecting the rotation mechanism to the vessel via the swivel member, the rotation mechanism is provided with an increased freedom of movement.

According to an embodiment the rotation mechanism extends along a longitudinal body axis from a first end which is rotatable connected to the frame, to a second end which is rotatable connected to the second end of the swivel member.

The rotation mechanism may be a linear actuator such as a hydraulic cylinder. The elongated member of the rotation mechanism may also be provided by a cable which is attached to the frame. The frame may be moved by varying the length of the cable.

According to an embodiment, the swivel member extends along a longitudinal body axis from the first end to the second end of the swivel member, the crane comprising a spacer arranged between the frame and one of the swivel member, the rotation mechanism and the connection between the swivel member and the rotation mechanism, preventing the longitudinal body axis of the rotation mechanism and the longitudinal body axis of the swivel member from reaching a parallel position.

In case the rotation mechanism and the swivel member would reach a parallel position, the mechanism could jam, i.e. the swivel member would not be able to move back to its inward position when the rotation mechanism moves the frame towards the upper position.

According to an embodiment the spacer is with a first end rotatable connected to the frame and with a second end rotatable connected to one of the swivel member, the rotation mechanism and the connection between the swivel member and the rotation mechanism.

According to an embodiment the first end of the spacer is connected to the frame in the vicinity of the hinge axis and the second end of the spacer is connected to one of the swivel member, the rotation mechanism and the connection between the swivel member and the rotation mechanism in the vicinity of the second end of the swivel member.

According to an embodiment the rotation mechanism comprises an elongated member which is with a first end connected to the frame at a position away from the horizontal hinge axis and with a second end connected to the second end of the swivel member, wherein the length of the elongated member can be varied in order to rotate the frame about the horizontal hinge axis.

According to an embodiment the crane comprises two or more parallel rotation mechanisms, each rotation mechanism being connected to the frame at a position away from the horizontal hinge axis. Using two parallel rotation mechanisms, for instance formed by linear actuators such as hydraulic cylinders, provides a relatively strong rotation mechanism capable of handling heavy loads. Also, it may be more cost-efficient to use two or more rotation mechanisms instead of one stronger rotation mechanism.

According to an embodiment the crane comprises two or more parallel swivel members, wherein each swivel member is with a first end rotatable connected to the deck and with a second end rotatable connected to a respective rotation mechanism. The two or more rotation mechanisms may be formed by two or more hydraulic actuators, which can be actuated simultaneously to rotate the frame. The frame may be a two-legged frame, with two legs fixed to the deck of the vessel in a rotatable manner, the two legs together forming the top of the crane. Each leg may be provided with a rotation mechanism.

SHORT DESCRIPTION OF THE DRAWINGS

Figure 2:
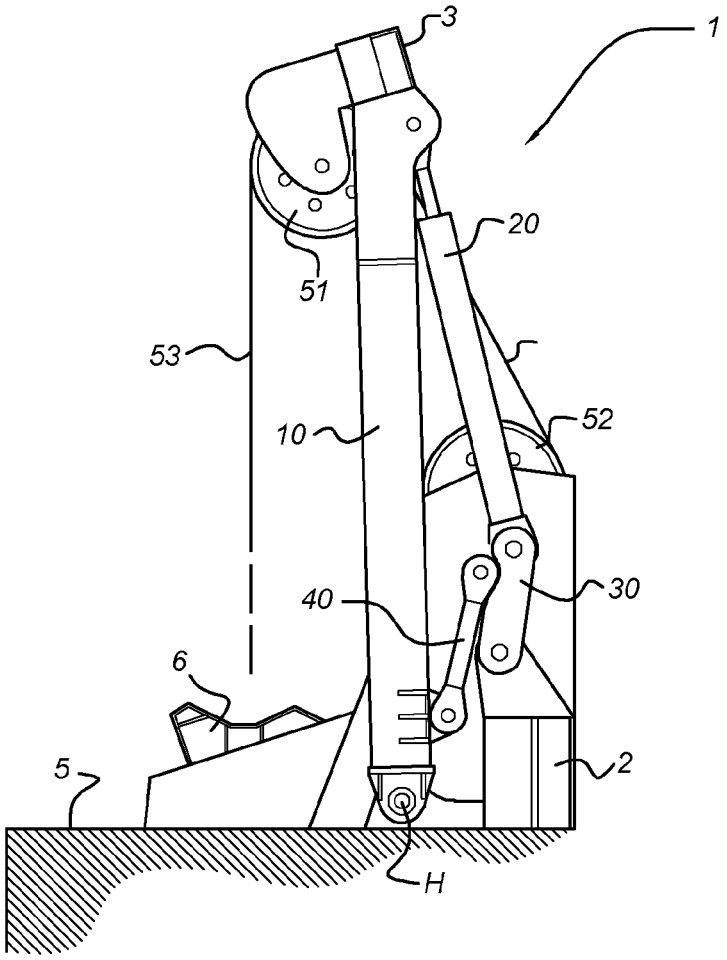
Figure 3:
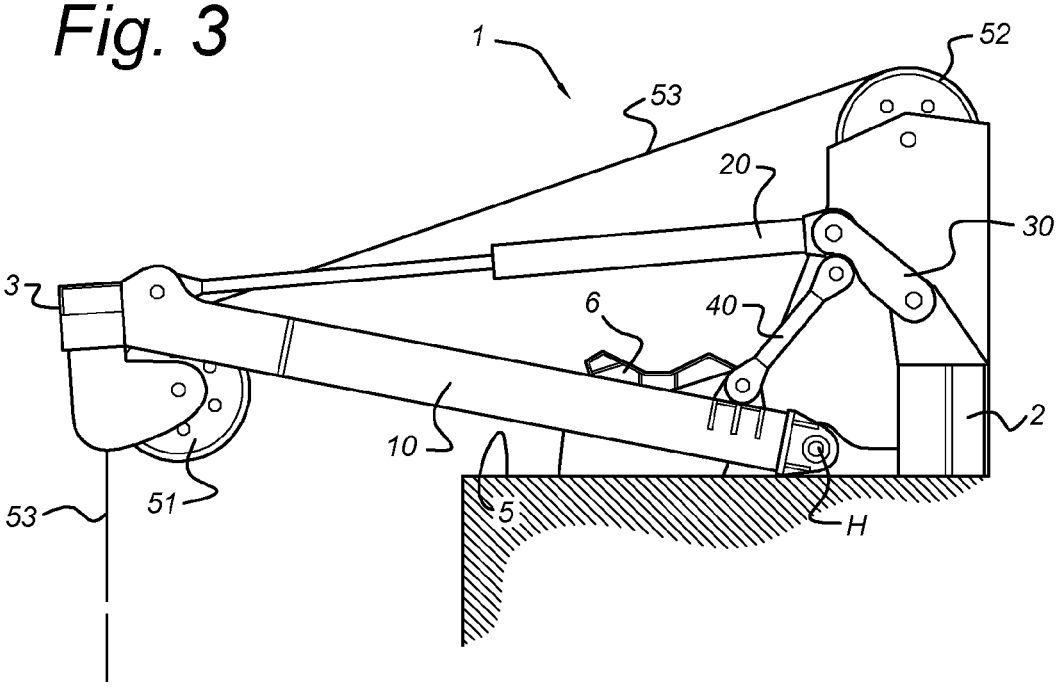

Embodiments will now be described, by way of example only, with reference to the accompanying schematic drawings in which corresponding reference symbols indicate corresponding parts, and in which:

FIG. 1 schematically depicts a crane according to an embodiment,

FIG. 2 schematically depicts a crane according to an embodiment in an upper position, and FIG. 3 schematically depicts a crane according to an embodiment in a lower position.

DETAILED DESCRIPTION

Embodiments will now be described by way of example with reference to the Figures.

FIG. 1 schematically depicts a crane 1 mounted on a deck 5 of a vessel 4 (only partially shown).

The crane 1 comprises a frame 10 which can be rotated about a horizontal hinge axis H. The crane 1 can be moved between an upper position (FIG. 2) and a lower position (FIG. 3). FIG. 1 shows the crane 1 in an intermediate position in between the upper position and the lower position.

By moving the crane 1 from the upper to the lower position (or vice versa), a load (not shown) can be moved from an onboard position to an overboard position (or vice versa).

On the deck 5 a receptacle 6 may be mounted directly under the top 3 of the crane 1 in the upper position. The receptacle 6 may be arranged to receive the load which is to be hoisted by the crane 1 from the receptacle 6 (onboard position) to an overboard position. The load may for instance be dredging equipment, such as a suction pipe or an excavation tool.

A rotation mechanism 20 is provided that is with a first end 21 rotatable connected to the frame 10. The connection between the rotation mechanism 20 and the frame 10 is preferably close to or at the top of the crane 3. The connection may be formed by a hinge connection fixedly attached to the frame 10. The rotation mechanism 20 is connected to the frame in a rotatable way, allowing the frame 10 and the rotation mechanism 20 to rotate with respect to each other about a hinge axis H1.

The rotation mechanism 20 is further provided with a second end 22 which is connected to the vessel 4 via swivel member 30.

The rotation mechanism 20 is an elongated device of which the longitudinal length can be varied. The rotation mechanism may be formed by a hydraulic actuator, comprising a cylinder and piston. According to an alternative, the rotation mechanism 20 may be formed by one or more cables and means to vary the length of the one or more cables to move the crane 1 between the upper position and the lower position. Lengthening the one or more cables will cause the frame 10 to move towards the lower position under the influence of gravity. Shortening the one or more cables will cause the frame 10 to move towards the upper position.

The crane 1 as depicted 1 can perform a relatively large rotation from upper position to lower position with a relatively small rotation mechanism 20, i.e. it can reach a relatively low lower position in which the frame 10 is in a horizontal or almost horizontal position. In the lower position, the top 3 of the crane 1 reaches a relatively low position which may be close to the deck level of the vessel 4 on which the crane 1 is positioned.

This is achieved because the rotation mechanism 20 is not fixedly attached to the vessel 4, but is attached to the vessel 4 via a swivel member 30, providing the rotation mechanism with an increased freedom of movement. The swivel member 30 is with a first end 31 connected to the vessel 4 by a hinge connection, allowing the swivel member 30 to rotate about a hinge axis H2 with respect to the vessel 4. The swivel member 30 may for instance be connected to a base member 2 which is attached to the deck 5 of the vessel 4. The base member 2 may be provided to ensure that the hinge axis H2 connecting the swivel member 30 to the vessel 1 is at a higher position with respect to the deck 5 of the vessel 4 than the hinge axis H connecting the frame 10 to the vessel 1.

The swivel member 30 is with a second end 32 rotatable connected to the second end 22 of the rotation mechanism 20 by means of a hinge connection, allowing the swivel member 30 and the rotation mechanism 20 to rotate with respect to each other about a hinge axis H3.

The swivel member 30 provides the rotation mechanism 20 with freedom of movement, allowing the crane 1 to reach a relatively low lower position with a relatively small rotation mechanism 20. Also, the size of the crane 1 can be reduced, occupying less deck area and being more cost-effective.

The frame 10 may be any suitable type of frame. The frame 10 may be an A-shaped frame 10, with two legs fixed to the deck of the vessel 4 in a rotatable manner and the peak of the frame 10 forming the top 3 of the crane. However, the frame 10 may also comprise a single leg.

The horizontal hinge axis H may be substantially parallel to a side of the vessel 4 close to which the crane 1 is mounted. The horizontal hinge axis H may for instance be parallel to a longitudinal body axis (not shown) of the vessel 4 running from stem to stem.

As can be seen in the FIGS. 1-3, the rotation mechanism 20 and the swivel member 30 are elongated members, extending along a longitudinal body axis. The longitudinal body axis of the rotation mechanism 20 is indicated with reference B20. The longitudinal body axis of the swivel member 30 is indicated with reference B30. Both longitudinal body axes B20, B30 are not in line with each other, but are at a relative angle α, which is non zero. Angle α may for instance be 5° or more, depending on the position of the frame 10.

In order to prevent the rotation mechanism 20 and the swivel member 30 from reaching a parallel position, in which angle α would be 0°, a spacer 40 is provided.

The spacer 40 may be a elongated member, for instance an elongated rod, which is provided to prevent the swivel member 30 and the rotation mechanism 20 to reach a parallel orientation. The spacer 40 may be provided in between the frame 10 and the swivel member 30.

A first end 41 of the spacer 40 may be connected to the frame 10 by means of a hinge connection, allowing the spacer 40 to rotate about a hinge axis H4 with respect to the frame 10. A second end 42 of the spacer 40 may be connected to the swivel member 30 by means of a hinge connection allowing the spacer to rotate about a hinge axis H5 with respect to the swivel member 30.

The first end 41 of the spacer 40 may be relatively close to the horizontal hinge axis H connecting the frame 10 to the deck 5 of the vessel 4.

The second end 42 of the spacer 40 may be relatively close to the hinge axis H3 connecting the swivel member 30 to the rotation mechanism 20.

According to an alternative embodiment (not shown), the hinge axis H5 associated with the second end 42 of the spacer 40 coincides with the hinge axis H3 provided between the rotation mechanism 20 and the swivel member 30. Both hinge axes H3, H5 may be integrally formed as one and the same hinge connection.

According to a further embodiment (not shown), the second end 42 of the spacer 40 may be connected to the rotation mechanism 20 at a position relatively close to the hinge axis H3 connecting the rotation mechanism 20 to the swivel member 30. The second end 42 of the spacer 40 may for instance be at a distance from the hinge axis H3 connecting the swivel member 30 to the rotation mechanism which is less than 10% of the total longitudinal length of the swivel member 30.

In general, the hinge connection (H5) associated with the second end 42 of the spacer 40 is positioned relatively close to the hinge connection (H3) connecting the rotation mechanism 20 to the swivel member 30 to keep the moment (product of the force and the moment arm) relatively small.

The first end 41 of the spacer 40 may be connected to the frame 10 at a first distance from the hinge axis H and the second end 42 of the spacer 40 may be connected at a second distance from hinge axis H3 associated with the second end 32 of the swivel member 30. The first distance is measured parallel to a longitudinal axis of the frame 10 and the second distance is measured parallel to the longitudinal axis of the swivel member 30.

The first distance may be greater than the second distance. The second distance may be zero.

The first distance may be less than 10% of the total longitudinal length of the frame 10. The second distance may be less than 10% of the total longitudinal length of the swivel member 30.

All hinge axes H-H5 are substantial horizontal and parallel with respect to each other.

As shown in the FIGS. 1-3, the crane 1 comprises a first guiding wheel 51 positioned at the top 3 of the crane 1 and a second guiding wheel 52 at the base 2 of the crane 1. The guiding wheels 51, 52 are provided for guiding a hoisting cable 53. The second guiding wheel 52 may function as a winch for controlling the length of the hoisting cable 53. Also separate winch means may be provided.

In use, the rotation mechanism 20 will be operated to control the position of the frame 10. When moving from the upper position to the lower position, the length of the rotation mechanism 20 will be increased, thereby rotating the frame 10 about the horizontal hinge axis H towards an overboard position. The swivel member 30 will also rotate about the hinge axis H2 connecting the swivel member 30 to the base member 2. As a result, the second end of the rotation mechanism 20 which is connected to the swivel member 30 will move towards the edge of the vessel 4, allowing the first end 21 of the rotation mechanism 20 to reach further. The frame 10 is thus provided with a freedom of movement which is larger than could be obtained with a rotation mechanism that would be coupled to the base member 2 directly.

During lowering of the frame 10, the length of the hoisting cable 53 may be controlled.

When moving from the lower position to the upper position, the length of the rotation mechanism 20 will be decreased, thereby rotating the frame 10 about the horizontal hinge axis H towards an onboard position. The swivel member 30 will also rotate about the hinge axis H2 connecting the swivel member 30 to the base member 2. As a result, the second end of the rotation mechanism 20 which is connected to the swivel member 30 will move to a more onboard position, i.e. away from the edge of the vessel 4. Simultaneously, the length of the hoisting cable 53 may be controlled.

According to an alternative embodiment, two or more rotation mechanisms 20 may be provided working in parallel. The rotation mechanisms 20 may be provided next to each other. One may for instance be connected to the frame 10 close to or at the top 3 of the crane, while another rotation mechanism may be connected to the frame 10 at a position away from the top 3 of the crane.

Each rotation mechanism 20 may be provided with its own swivel member 30. However, the two or more rotation mechanisms 20 may also be connected via one mutual swivel member 30.

Descriptions above are intended to be illustrative, not limiting. Thus, it will be apparent to one skilled in the art that modifications may be made to the invention as described without departing from the scope of the claims set out below.

LIST OF ELEMENTS

1 crane
2 base member
3 top of crane
4 vessel
5 deck
6 receptacle
10 frame
20 rotation mechanism
21 first end of rotation mechanism
22 second end of rotation mechanism
30 swivel member
31 first end of swivel member
32 second end of swivel member
40 spacer
41 first end of spacer
42 second end of spacer
51 first guiding wheel

52 second guiding wheel
53 hoisting cable
H horizontal hinge axis
H1-H5 hinge axes
B20-B30 longitudinal body axes

The invention claimed is:

1. A vessel comprising:
a deck; and
a crane connected to the deck of the vessel, the crane comprising
a frame which is rotatable about a first, horizontal hinge axis,
a rotation mechanism connected to the frame at a position away from the first, horizontal hinge axis, which is arranged to rotate the frame about the first, horizontal hinge axis from an upper position to a lower position and vice versa, a top of the crane being higher in the upper position than in the lower position, and
a swivel member, which is with a first end rotatably connected to the deck about a second hinge axis which is at a position away from the first, horizontal hinge axis, and with a second end rotatably connected to the rotation mechanism, the swivel member being rotatable from an inward position associated with the upper position of the frame to an outward position associated with the lower position of the frame and vice versa.

2. The vessel according to claim 1, wherein the rotation mechanism extends along a longitudinal body axis from a first end which is rotatably connected to the frame and a second end which is rotatably connected to the second end of the swivel member.

3. The vessel according to claim 2, wherein the swivel member extends along a longitudinal body axis from the first end to the second end of the swivel member,
the crane further comprising:
a spacer disposed between the frame and one of the swivel member, the rotation mechanism, and a connection between the swivel member and the rotation mechanism, preventing the longitudinal body axis of the rotation mechanism and the longitudinal body axis of the swivel member from reaching a parallel position.

4. The vessel according to claim 3, wherein the spacer is with a first end rotatably connected to the frame and with a second end rotatably connected to one of the swivel member, the rotation mechanism, and the connection between the swivel member and the rotation mechanism.

5. The vessel according to claim 4, wherein the first end of the spacer is connected to the frame in the vicinity of the first hinge axis and the second end of the spacer is connected to one of the swivel member, the rotation mechanism, and the connection between the swivel member and the rotation mechanism in the vicinity of the second end of the swivel member.

6. The vessel according to claim 1, wherein the rotation mechanism comprises a longitudinal member which is with a first end connected to the frame at a position away from the first, horizontal hinge axis and with a second end connected to the second end of the swivel member, the length of the longitudinal member being variable in order to rotate the frame about the first, horizontal hinge axis.

7. The vessel according to claim 1, wherein the crane comprises two or more parallel rotation mechanisms, each rotation mechanism being connected to the frame at a position away from the first, horizontal hinge axis.

8. The vessel according to claim 7, wherein the crane comprises two or more parallel swivel members,
wherein each swivel member is with a first end rotatably connected to the deck and with a second end rotatably connected to a respective rotation mechanism.

9. The vessel according to claim 2, wherein the rotation mechanism comprises a longitudinal member which is with a first end connected to the frame at a position away from the first, horizontal hinge axis and with a second end connected to the second end of the swivel member, the length of the longitudinal member being variable in order to rotate the frame about the first, horizontal hinge axis.

10. The vessel according to claim 3, wherein the rotation mechanism comprises a longitudinal member which is with a first end connected to the frame at a position away from the first, horizontal hinge axis and with a second end connected to the second end of the swivel member, the length of the longitudinal member being variable in order to rotate the frame about the first, horizontal hinge axis.

11. The vessel according to claim 4, wherein the rotation mechanism comprises a longitudinal member which is with a first end connected to the frame at a position away from the first, horizontal hinge axis and with a second end connected to the second end of the swivel member, the length of the longitudinal member being variable in order to rotate the frame about the first, horizontal hinge axis.

12. The vessel according to claim 5, wherein the rotation mechanism comprises a longitudinal member which is with a first end connected to the frame at a position away from the first, horizontal hinge axis and with a second end connected to the second end of the swivel member, the length of the longitudinal member being variable in order to rotate the frame about the first, horizontal hinge axis.

13. The vessel according to claim 2, wherein the crane comprises two or more parallel rotation mechanisms, each rotation mechanism being connected to the frame at a position away from the first, horizontal hinge axis.

14. The vessel according to claim 3, wherein the crane comprises two or more parallel rotation mechanisms, each rotation mechanism being connected to the frame at a position away from the first, horizontal hinge axis.

15. The vessel according to claim 4, wherein the crane comprises two or more parallel rotation mechanisms, each rotation mechanism being connected to the frame at a position away from the first, horizontal hinge axis.

16. The vessel according to claim 5, wherein the crane comprises two or more parallel rotation mechanisms, each rotation mechanism being connected to the frame at a position away from the first, horizontal hinge axis.

17. The vessel according to claim 6, wherein the crane comprises two or more parallel rotation mechanisms, each rotation mechanism being connected to the frame at a position away from the first, horizontal hinge axis.

18. The vessel according to claim 1, wherein the second hinge axis is at a higher position with respect to the deck than the first hinge axis.

19. The vessel according to claim 1, wherein the swivel member is not directly connected to the frame.

20. The vessel according to claim 1, wherein the rotation mechanism is connected to the frame at close to or at the top of the frame.

* * * * *